US006435362B1

(12) United States Patent
Dekorti

(10) Patent No.: US 6,435,362 B1
(45) Date of Patent: Aug. 20, 2002

(54) ATTACHMENT FOR EXTRACTION OF CORKS AND SIMILAR BOTTLE STOPPERS

(76) Inventor: Drago Dekorti, Sencna pot 85, 6320 Portoroz (SI)

( * ) Notice: Subject to any disclaimer, the term of this patent is extended or adjusted under 35 U.S.C. 154(b) by 0 days.

(21) Appl. No.: 09/701,519

(22) PCT Filed: May 28, 1999

(86) PCT No.: PCT/SI99/00015

§ 371 (c)(1),
(2), (4) Date: Jan. 22, 2001

(87) PCT Pub. No.: WO99/61363

PCT Pub. Date: Dec. 2, 1999

(30) Foreign Application Priority Data

May 28, 1998 (SI) ..... 9800157
May 28, 1999 (SI) ..... 9900131

(51) Int. Cl.[7] ..... B67B 7/06

(52) U.S. Cl. ..... 215/296; 215/297; 215/299; 215/306; 215/305; 215/364; 81/3.07; 81/3.45; 81/3.48

(58) Field of Search ..... 215/295–297, 215/299, 305, 306, 364; 220/275; 81/3.07, 3.15, 3.45, 3.48

(56) References Cited

U.S. PATENT DOCUMENTS

| | | | | | |
|---|---|---|---|---|---|
| 79,536 | A | * | 7/1868 | Alexander | 215/297 |
| 191,295 | A | * | 5/1877 | Arnold | 215/296 |
| 388,785 | A | * | 8/1888 | Nutter | 215/297 |
| 690,013 | A | * | 12/1901 | Chambers | 215/297 |
| 876,002 | A | * | 1/1908 | Kraft et al. | 220/375 |
| 1,222,765 | A | * | 4/1917 | Hudson | 215/297 |
| 1,416,616 | A | * | 5/1922 | Crane | 215/296 |
| 1,464,646 | A | * | 8/1923 | Cross | 215/297 |
| 1,474,105 | A | * | 11/1923 | Camp et al. | 215/296 |
| 6,227,399 | B1 | * | 5/2001 | Angus et al. | 220/375 |

* cited by examiner

*Primary Examiner*—Nathan J. Newhouse
(74) *Attorney, Agent, or Firm*—Abelman, Frayne & Schwab

(57) ABSTRACT

The invention refers to the attachment for extraction of cork and similar bottle stoppers enabling extraction of cork stopper without application of additional tool and/or special opener, designed for the respective purpose. The attachment referred to in this invention consists of the basic threaded body (2) with a tape shaped pull cord (5) coming out of the upper part of the attachment. The attachment referred to in this invention may also be built in the body (1) as a screw (2') with a preliminarily inserted washer (3) provided with a groove (4) that serves as a channel for the pull cord (5'). In the second example the attachment in the body (1') is shaped as a screw (2') with recess (7) with an edge (8) at the bottom, while the pull cord (5') is attached to the bayonet plug (9).

3 Claims, 3 Drawing Sheets

ATTACHMENT FOR EXTRACTION OF CORKS AND SIMILAR BOTTLE STOPPERS

The invention refers to the attachment for extraction corks and similar bottle stoppers whereby a cork can be drawn from the bottle without application of any additional tool and/or special opener designed for the respective purpose. The invention belongs to class B 67B 07/04 of the international patent classification.

The technical problem successfully solved by the invention in question refers to the design and construction of such attachment that will allow for extraction a cork or similar bottle stopper without any additional bottle opener.

The problem of opening the bottles closed with corks can only be solved with the application of a special bottle opener. Several versions of openers have been known where the main part is constituted of a bar twisted into a spiral body that is to be introduced into the cork. The simplest version of such attachment is fitted with a transversal handle on the top that allows for extraction of the cork with a simple pull. Besides, there are various other versions that allow for easier extraction. Such versions are, for instance, described in WO 97/01504, WO 96/15062, EP 620 154 patent documents.

All the above described versions of bottle openers do not solve the technical problem of opening bottles, closed with a cork or similar stopper, without application of an additional bottle opener. But the invention in question, however, aims at construction of such attachment for extraction corks or similar bottle stoppers that allows for extraction without application of an additional tool and/or bottle opener. For this purpose the attachment is designed as a twisted body to be introduced into the stopper, provided with a pull type string on the top. There may also be a screw introduced into the body of the bottle stopper; it is connected with the opening string via a special washer or with a bayonet pin.

The invention will be explained in detail on the basis of concrete examples and the corresponding figures whereof FIG. 1 shows the extraction attachment referred to in this invention, as a side view and top view;

Figure 1:
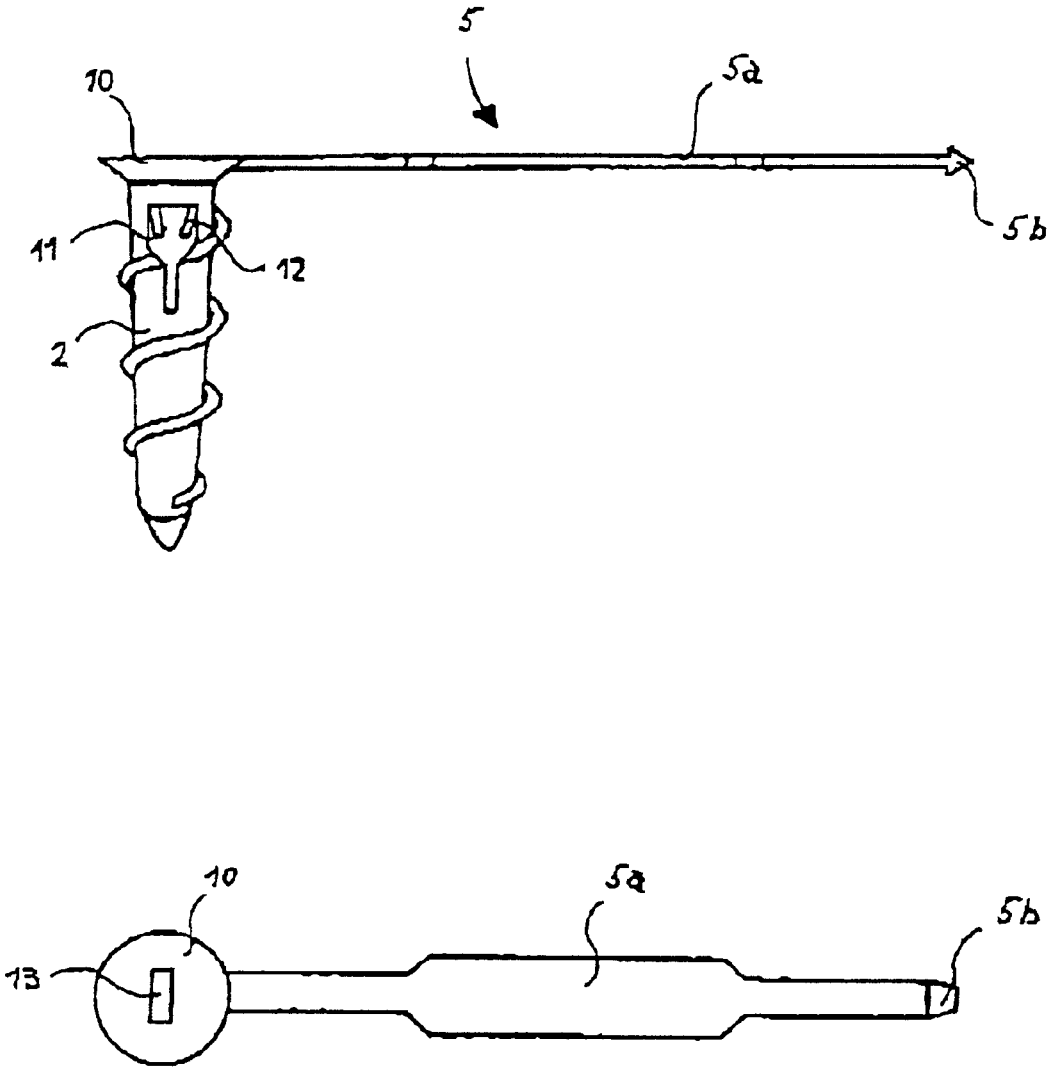

The attachment for extraction corks and similar stoppers, such as shown in FIG. 1, consists of the basic body 2 that is designed as a twisted attachment with a pull type string 5 in the form of a flat narrow tape arising out of the upper part 10. In the center of the pull type string 5 there is a part 5*a* of double width of the pull type string. At the end the pull type string is fitted with a pointed termination 5*b* in the form of a small arrow.

The basic body 2 in the form of a twisted attachment consists of a conical body, threaded on the outer circumference. In the upper third of the height of the basic body there is a hole 11, transversal to the main axle of the body; it is more or less square, conically narrowing towards its lower part and right at the end becoming a narrow slot. In the upper part of this transversal hole there is on each side a symmetrical short flat rectangular attachment 12.

On the top, the basic body 2 is terminated by the part 10 in the form of a low truncated cone turned upside down, provided with a centric rectangular hole 13 in the base plate.

The attachment referred to in this invention is mechanically or manually twisted into the stopper at the filling and closing of the bottle. The pull type string 5 runs along the bottleneck and is covered, e.g. with paper that covers the stopper in the way that the end of the pull type string 5 stretches beyond the paper. At opening the bottle we grasp this end of the string and use it to tear off the papers whereafter we insert the end 5*b* into the opening 13 of the upper part 10. As the end 5*b* is shaped like a small arrow, it gets stuck with its flat attachments 12 inside the body 2, whereby the pull type string forms a firm loop whereby it is possible to draw the stopper from the bottle.

Figure 2:
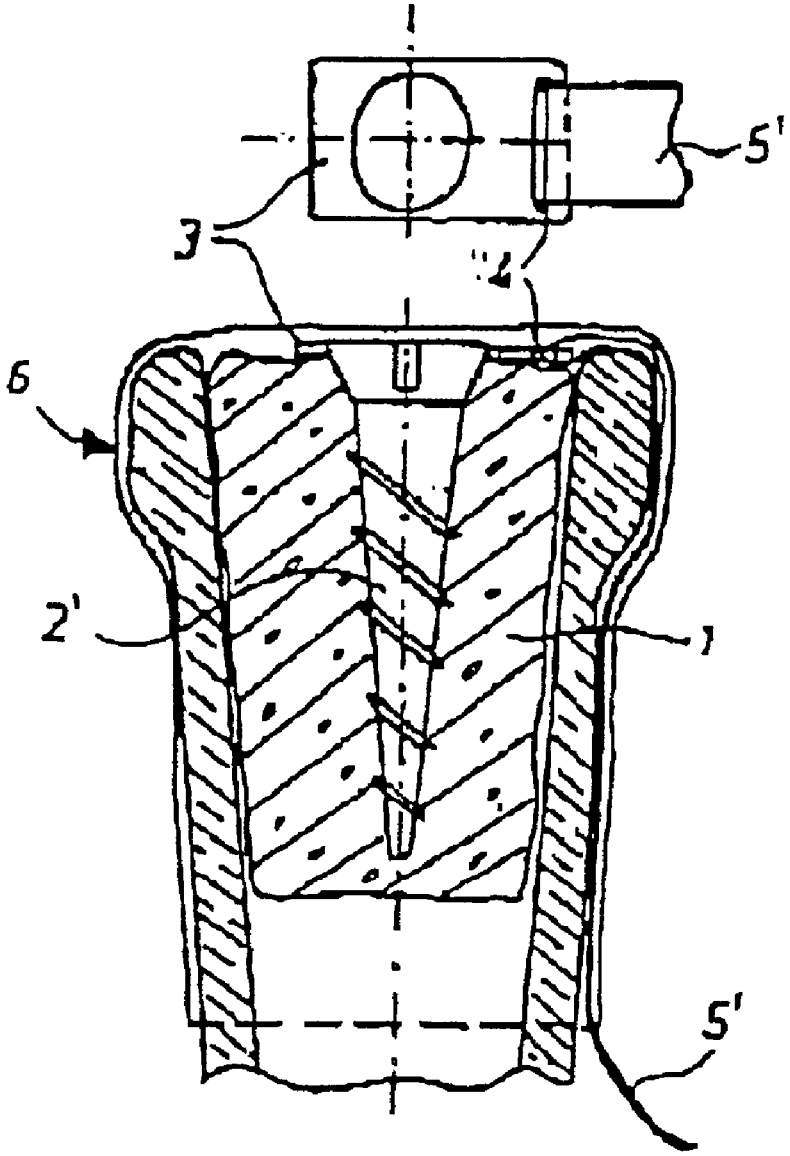
FIG. 2 shows a cork containing the bottle opener referred to in this invention and in the second example the cross-section thereof.
Figure 3:
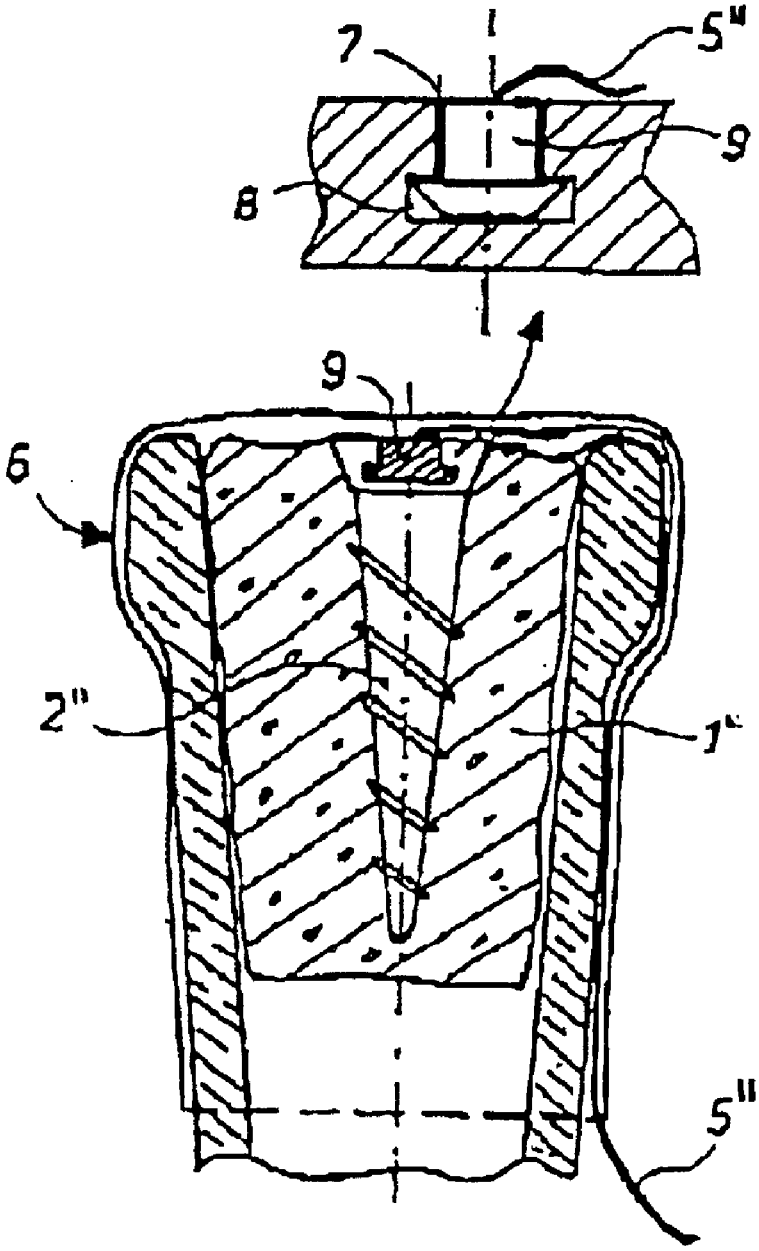
FIG. 3 shows a cork with a built-in bottle opener, such as referred to in this invention, presented as a cross-section of the third example.

Another version of the solution of the technical problem in question, such as presented in FIGS. 2 and 3, shows a bottle cork with a screw 2' inserted into the body 1, provided with a preliminarily inserted washer 3 with a grove 4 for the pull type string 5'. As the corks are generally covered with a paper or plastic cap 6, the pull type string 5 runs along the outer part of the bottle neck in the way that it lies outside the above cap 6.

When opening the bottle we pull the free end of the pull type string 5, whereby we first tear the cap 6 and thereafter draw also the body 1 of the cork.

The bottle cork with a built-in bottle opener, such as referred to in this invention and shown as the cross-section of the second example in FIG. 2, contains in the body 1' the screw 2" with a recess 7, with the edge 8 along the bottom, while the pull type string 5' is fixed to the bayonet pin 9.

The screw 2" is introduced into the cork body 1', whereafter follows the insertion of the bayonet pin 9 with the pull type string 5'. The screw 2" is inserted into the body 1' in the way that it is level with the upper edge of the cork body 1'. In case of this version, too, the pull type string 5' runs along the outer part of the bottle neck in the way that it lies outside the cap 6; thus at opening the bottle we pull the free end of the pull type string 5', whereby we first tear the cap 6 and thereafter draw the cork body 1' from the bottle.

What is claimed is:

1. A device for extracting a cork or stopper sealing an open end of a bottle comprising:

a tapered elongated threaded member having a longitudinal axis;

the threaded member having a head portion;

the threaded member threadably received within the cork or stopper with the head portion exposed;

the head portion provided with a rectangular-shaped opening extending through the head portion transverse to the longitudinal axis of the threaded member;

the rectangular-shaped opening having a longitudinal width and a lateral width;

the head portion further provided with an axial opening extending from a top surface of the screw and communicating into the rectangular-shaped opening;

the axial opening having a width;

a pull string having one end fixedly secured to the threaded member;

a triangular-shaped end piece with a base;

the base of the triangular-shaped end piece secured to a free end of the pull string;

the base sized to have a lateral width greater than the lateral width of the rectangular opening but less than the longitudinal width of the rectangular opening and less than the width of the axial opening;

whereby when the triangular-shaped end piece is inserted through the axial opening and the rectangular opening and the end piece rotated until the base is positioned across the lateral width of the rectangular opening, the base of the triangular end piece is prevented from retracting through the rectangular opening, and the cork or stopper is removable by pulling on the string.

2. A device for extricating a cork or stopper sealing an open end of a bottle comprising:

an elongated threaded member having a longitudinal axis;

the threaded member further having a body portion and a head portion with the head portion having a diameter larger than the diameter of the body portion;

a washer having a central opening for receiving the threaded member, the central opening sized to have a diameter smaller than the diameter of the head portion;

a pull string having one end attached to the washer and the free end extending away from the washer;

the threaded member positioned to extend through the central opening of the washer and threadably received within a top end of the cork or stopper;

whereby the washer is secured to the top end of the cork or stopper.

3. A device for extracting a cork or stopper sealing an open end of a bottle comprising:

a tapered elongated threaded member having a longitudinal axis;

the threaded member having a head portion;

the head portion provided with an axial opening extending from a top surface of the threaded member;

the axial opening shaped to have an upper cylindrical orifice having a first diameter and opening into a lower cylindrical orifice having a second diameter larger than the first diameter;

a bayonet pin having means for removably locking an end of the bayonet pin within the lower cylindrical opening;

a pull string having one end secured to the bayonet pin and a free end extending away from the bayonet pin.

* * * * *